US006619964B2

(12) United States Patent
Geltsch et al.

(10) Patent No.: US 6,619,964 B2
(45) Date of Patent: Sep. 16, 2003

(54) CONNECTION SYSTEM FOR FLEXIBLE FLAT STRIP CABLES WITH CAM

(75) Inventors: Hans-Otto Geltsch, Berg-Sindlbach (DE); Michael Hopf, Nuremberg (DE)

(73) Assignee: FCI (FR)

( * ) Notice: Subject to any disclaimer, the term of this patent is extended or adjusted under 35 U.S.C. 154(b) by 0 days.

(21) Appl. No.: 10/137,877

(22) Filed: May 1, 2002

(65) Prior Publication Data

US 2002/0192999 A1 Dec. 19, 2002

(30) Foreign Application Priority Data

May 2, 2001 (DE) ..... 101 21 307

(51) Int. Cl.[7] ..... H01R 9/09
(52) U.S. Cl. ..... 439/67
(58) Field of Search ..... 439/495, 863, 439/725, 835, 498, 67

(56) References Cited

U.S. PATENT DOCUMENTS

| | | | | |
|---|---|---|---|---|
| 2,952,002 A | | 9/1960 | Angele et al. | 339/75 |
| 3,114,587 A | | 12/1963 | Herrmann | 339/75 |
| 4,420,206 A | | 12/1983 | Martyniak | 339/75 M |
| 4,759,726 A | * | 7/1988 | Naylor et al. | 439/441 |
| 6,210,190 B1 | * | 4/2001 | Huang et al. | 439/260 |

FOREIGN PATENT DOCUMENTS

| | | |
|---|---|---|
| DE | 19920981 A1 | 11/1999 |
| DE | 19832011 A1 | 2/2000 |
| DE | 19832012 A1 | 2/2000 |
| EP | 0030639 A1 | 6/1981 |
| EP | 1030407 A1 | 8/2000 |

* cited by examiner

*Primary Examiner*—Lynn Feild
*Assistant Examiner*—Phuong K T Dinh
(74) *Attorney, Agent, or Firm*—Perman & Green, LLP

(57) ABSTRACT

The present invention relates to a connection system for the connection of a branch flexible flat strip cable (1*b*) including a principal flexible flat strip cable (1*a*), by means of a cam (3), arranged in a housing (2), for pressing areas of contact of cables against one another (1*a*,1*b*), those being areas of the cable from which insulation has been stripped.

10 Claims, 4 Drawing Sheets

2
1a
1b
2a
2b
3b
4
5
6
7
8
9
10
11
14
15
18
19
21
22
23

CONNECTION SYSTEM FOR FLEXIBLE FLAT STRIP CABLES WITH CAM

BACKGROUND OF THE INVENTION

1. Field of the Invention

The present invention relates to a connection system for flexible flat strip cables, which are increasingly being used in motor vehicles, where they distribute signals and power to individual consuming points sensors and the like, into a system of principal flat strip cables and branch flat strip cables.

2. Description of Prior Developments

Since different wiring diagrams with connection systems are required according to equipment variant and accessories, there is a need for a flexible connection system, which makes it possible to connect branch conductors simply and rapidly to where they are needed. At the same time, it should be possible to make secure contact at low contact resistance.

SUMMARY OF THE INVENTION

The present invention accordingly has the purpose of providing a connection system of the type as explained above which, given simple and rapid handling and an uncomplicated construction, makes it possible to make secure contact at low contact resistance.

The present invention is based on the idea of locally stripping the insulation from the flexible flat strip cables and of pressing the stripped areas against one another by means of the cam, where the corresponding areas of contact are pressed against one another by means of the cam and during the process of the closing of the cam, the areas of contact rub against one another over a short distance, so that they clean one another, whereby the contact resistance is reduced.

BRIEF DESCRIPTION OF THE DRAWINGS

The invention is explained in greater detail by means of the description of a preferred embodiment example and by reference to the following drawings.

DETAILED DESCRIPTION OF THE PREFERRED EMBODIMENTS

Figure 1:
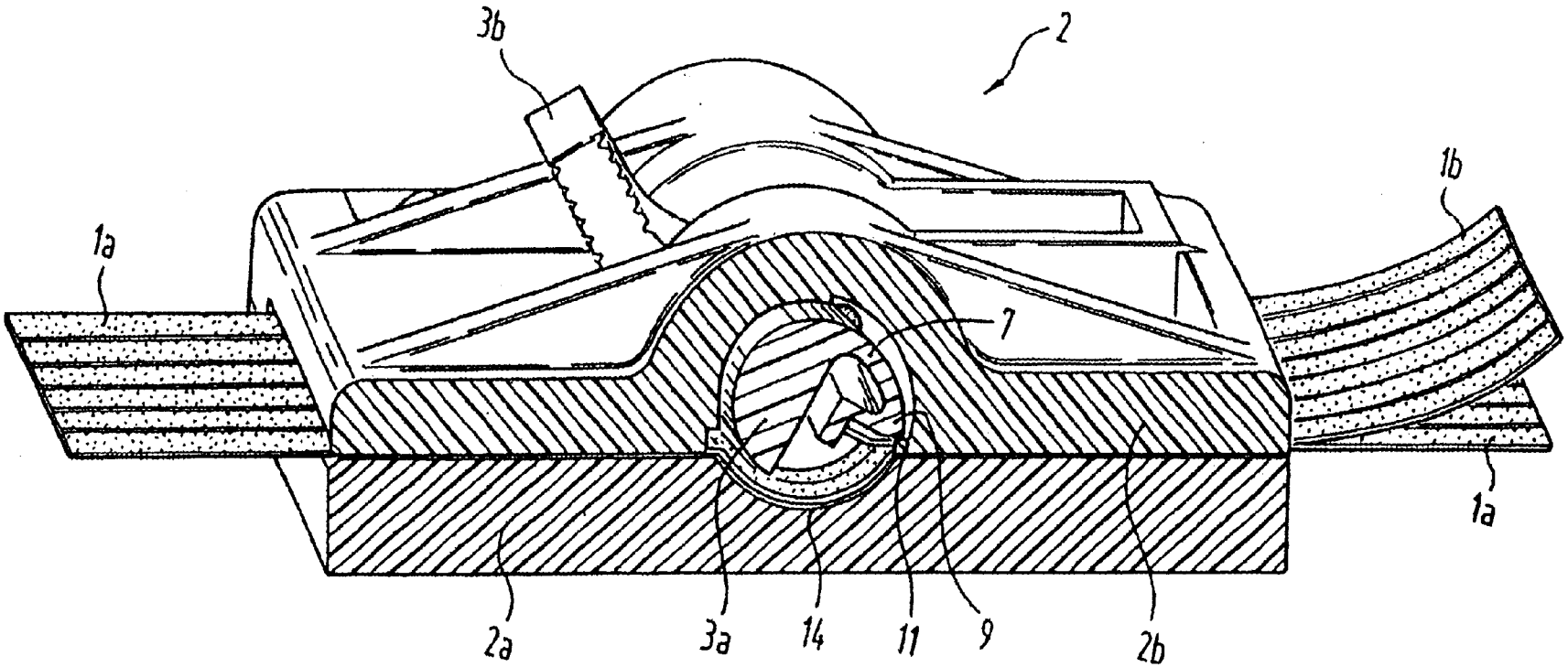
FIG. 1 shows a perspective view of an embodiment example of the flexible connection system according to the invention.

FIG. 1 shows the cam 3 in its housing 2, through which a principal flexible flat strip cable 1*a* is led, on whose right side a branch flexible flat strip cable 1*b* is placed, which is introduced into the housing 2 as far as the cam and pressed by the latter in the area of contact onto the principal flexible flat strip cable 1*a*. The housing 2 consists of a lower part 2*a* and an upper part 2*b*, which are connected with one another by means of locking elements 17 shown in FIG. 3*b*, but not in FIG. 1. A groove 14 in the shape of a cylinder is formed into the lower part 2*a* of the housing, which represents a part of the bearing of cam 3. The cam 3 has a drum 3*a* and a lever 3*b*. The drum 3*a* is, as can best be seen in FIG. 2, executed in one-half of the cross-section and in the other half of the cross-section the drum cover surface is formed by a flexible arm 7 extending over rather more than a quadrant of a circle. Its free end is bent radially towards the centre point of the drum and when the flexible arm 7 is relaxed, ends at a certain distance from the flat surface of the complete circle segment. The free end of the flexible arm 7 also has an impact surface 10 for the front edge of the branch flexible flat strip cable 1*b*. This is inserted via the principal cable 1*a* into the housing 2, until it impinges on the impact surface 10. By means of continuing insertion of the branch cable 1*b* until the impact surface 10 itself has impinged on surface 21, the flexible arm 7 is bent so far inwards that its edge 9 is led away by a shoulder 11 which together form a click-and-pawl mechanism, so that the drum can be rotated by means of actuating the lever 3*b* into the end lock-in position shown in the lower part of FIG. 2. The shoulder 11 is arranged in the upper part 2*b* of the housing, somewhat above the level at which the principal cable 1*a* is substantially led into the housing. When the drum is rotated, the branch cable 1*b* is pulled by the drum and that part of it which has been stripped of its insulation slides over the area of the principal cable 1*a*, which has likewise been stripped of its insulation. By means of the eccentric cross section of the drum 3*a*, the pressure whereby the area of the branch cable 1*b* is being pressed on the area 13 of the principal cable 1*a* which has likewise been stripped of its insulation, gradually becomes greater, until the end lock-in position has been reached. This mutual friction between the areas from which insulation has been stripped removes dirt, so that the contact resistance of the area of contact is reduced.

In order to increase the frictional adhesion between the cam drum 3*a* and the branch cable 1*b*, a transverse rib 23 made from an elastomer or silicone or the like is formed into the cover surface of the drum 3*a*.

Figures 2A, 2B, 2C:
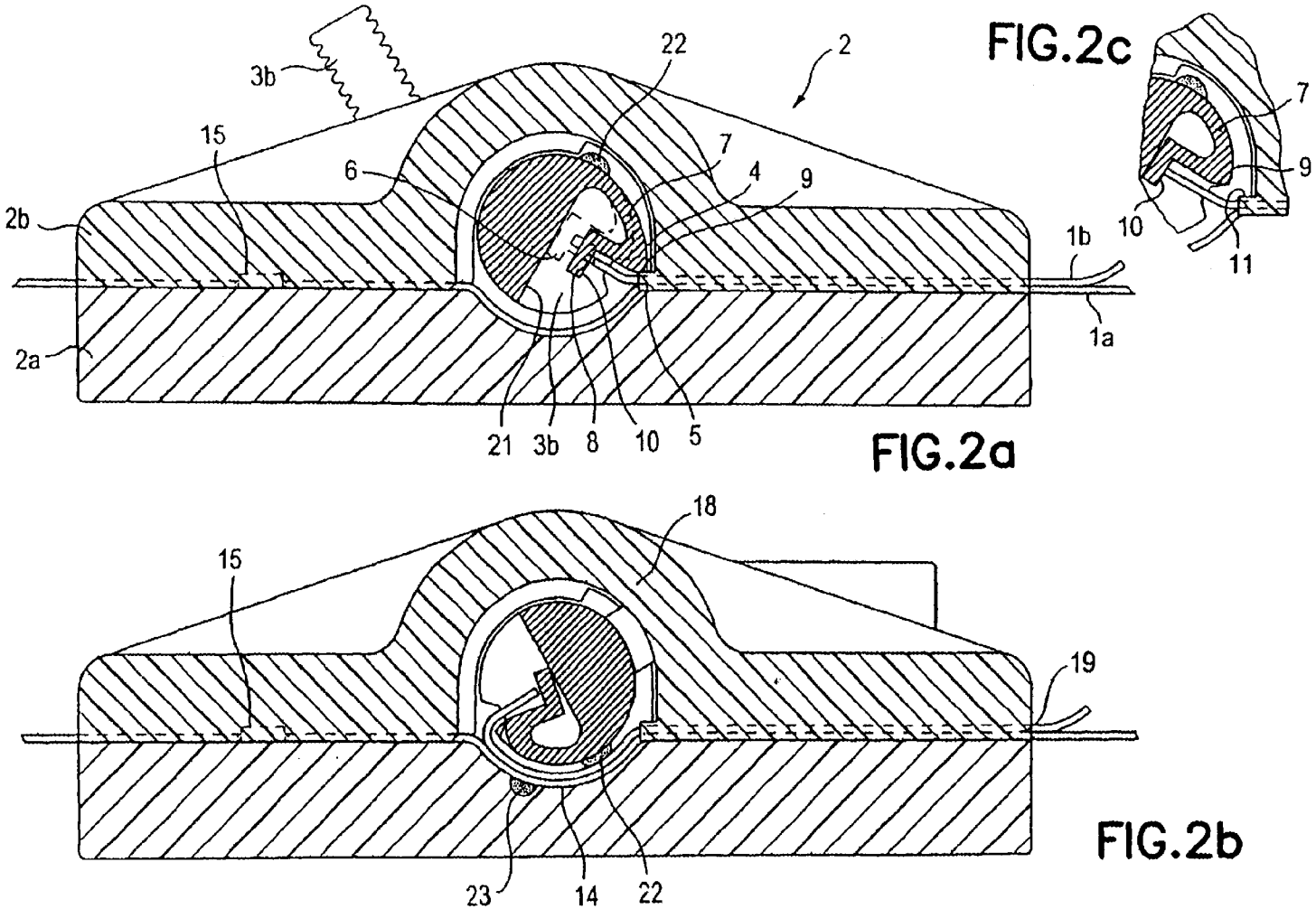
FIG. 2 shows two cross-sectional views of the cam, respectively in the front lock-in and end lock-in position.
Figure 3B:
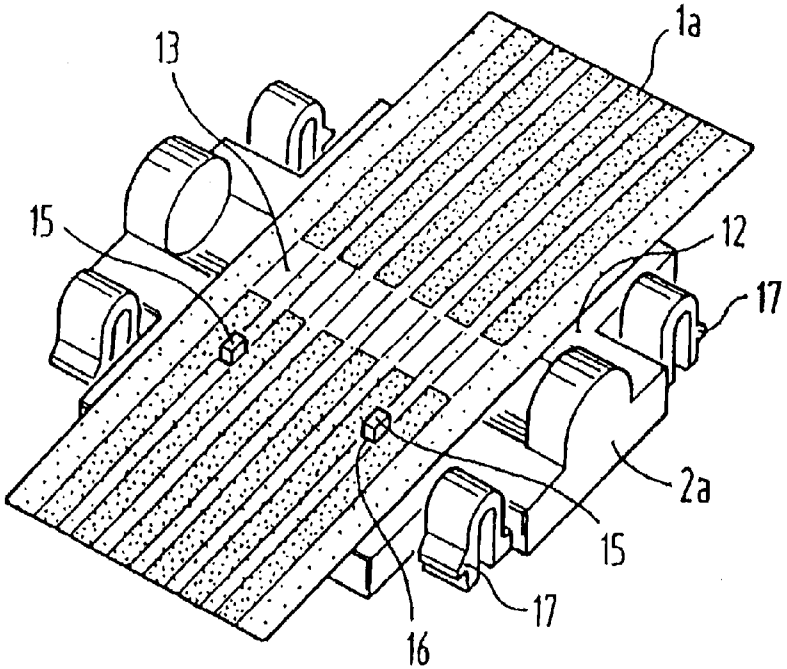
FIGS. 3*a* to *e* shows the process of assembly, when connecting the connection system to a principal flexible strip cable.
Figure 3A:
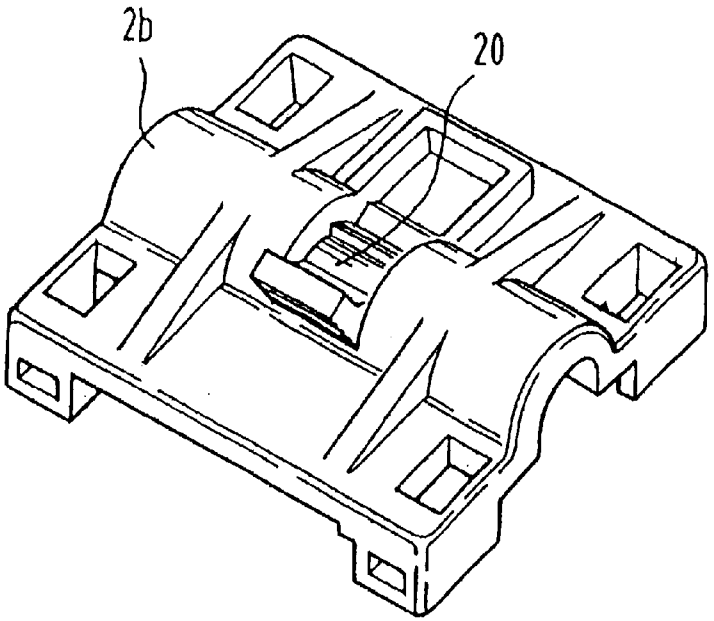
Figure 3D:
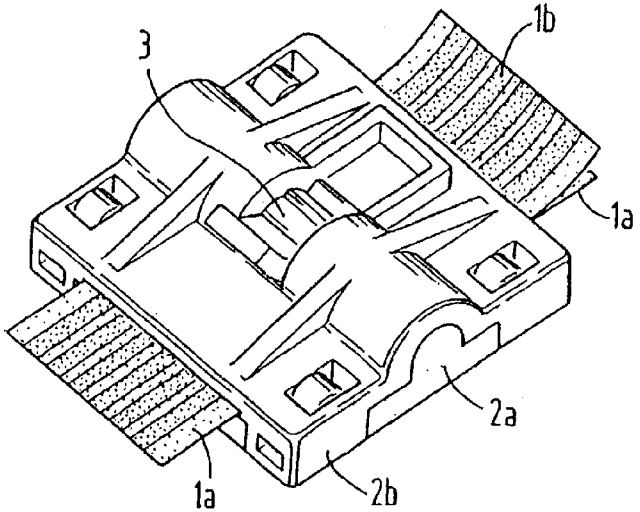
Figure 3C:
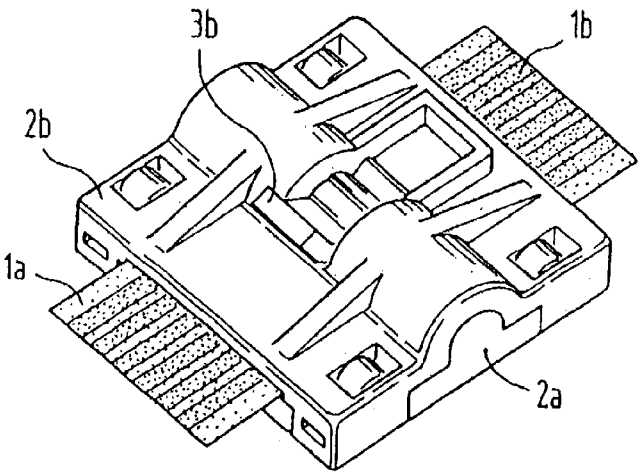
Figure 3E:
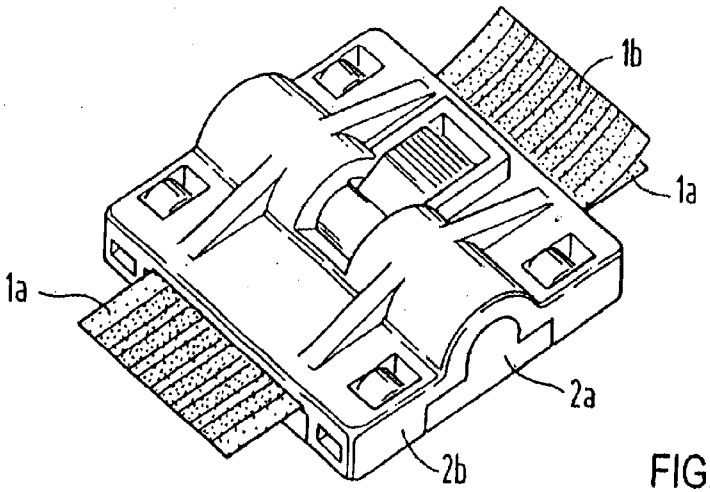

FIG. 3 shows the process of assembly of the connection system. FIG. 3*a* shows the upper housing part 2*b*. FIG. 3*b* shows the lower housing part 2*a*, with the principal cable 1*a* lying inside it. Its part 13 from which insulation has been stripped lies in the vicinity of the cylinder cover segment-shaped groove 14. For exact positioning, locking stops 15 are provided in the reception area for the principal cable 1*a*, which snap into the corresponding punched openings in the principal cable 1*a*. Following the insertion of the principal cable 1*a* into the floor 12 of the lower housing part 2*a*, the upper housing part 2*b* is inserted onto the lower housing part 2*a* and locked with the latter by means of locking hooks 17. The upper housing part 2*b* has on one of its sides a reception slot 19 for the branch cable 1*b* (FIG. 3*a*) into which the branch cable 1*b* is inserted, until the impact surface 10 impinges on the surface 21 (FIGS. 3*c*, d). As can be seen in FIG. 2, this releases the ratchet mechanism 9,11, so that the cam lever 3*b* can be shifted into the end lock-in position. FIG. 3*e* shows the cam in its end lock-in position shown in the lower part of FIG. 2. In this position, the areas of contact of the flexible flat strip cables 1*a*,1*b*, which are to be connected, lie on top of one another and are pressed against one another by the flexible arm 7 and the transverse rib 22 which is arranged thereon.

The loosening of the connection between the branch cable 1*b* and the principal cable 1*a* takes place in reverse order, without requiring any special tools.

In this way, it is possible to make the connection rapidly and using a simple means, where good contact is established between the cables 1*a*, 1*b*, which are to be connected with one another by means of the high pressure on the areas of contact and the prior friction between the said areas of contact.

What is claimed is:

1. A branch connection system for the connection of a branch flexible flat strip cable to a principal flexible flat cable the system comprising a cam arranged in a housing for mounting on a medial portion of the principal flexible flat strip cable so that when the housing is mounted on the principal flexible flat strip cable, the principal flexible flat strip cable continues extending from opposite ends of the housing, wherein the cam in the housing is adapted for the pressing against one another of areas of the cables which are stripped from insulation.

2. A connector system according to claim 1, wherein said cam includes a click and pawl mechanism, which only allows a change from a loosened position into an end position, when said branch flexible flat strip cable is introduced into a cam drum until the branch flexible flat strip cable meets a stop.

3. A connection system according to claim 2, wherein a free end of an elastic arm impinges against a surface of a circular segment-shaped cut-out of said cam and thus defines the exact positioning of said branch flexible flat strip cable with respect to said housing.

4. A connection system according to claim 3, wherein said elastic arm has on its outer face an elastomer or silicone transversal rib, in order to improve adhesion.

5. A connection system for the connection of a branch flexible flat strip cable comprising a principal flexible flat strip cable with a cam arranged in a housing, adapted for the pressing against one another of areas of the cables which are stripped from insulation, wherein said cam includes a click and pawl mechanism, which only allows a change from a loosened position into an end position, when said branch flexible flat strip cable is introduced into a cam drum until the branch flexible flat strip cable meets a stop, and wherein said cam drum, forms in its cross-section an open circle segment, which is partially closed by an elastic arm forming part of a drum cover, whose free end is bent toward the axis of said drum with the formation of a locking edge, and has an impact surface for the front edge of said branch flexible flat strip cable, where the flexible arm reduces, by means of pressing of said branch flexible flat strip cable against the impact surface, the radial distance of its locking edge from said drum axis, so that the locking edge rotates past a locking shoulder correspondingly formed in said housing and said cam can be shifted into a locked position.

6. A connection system according to claim 5, wherein said housing includes a lower part with a floor for the reception and the fixing of the position of said principal flexible flat strip cable, such that the area from which insulation has been stripped, lies in a transverse groove which forms part of said cam bearing, with locking stops for the adjustment of the position of said cable via correspondingly punched openings and with locking hooks for the fastening of an upper part of said housing.

7. A connection system according to claim 6, wherein said housing has an upper part with a cam bearing, introduction slots for the branch flexible flat strip cables and an opening for the introduction of the operating lever of the cam.

8. A connection system according to claim 7, wherein said locking shoulder is arranged in said upper housing part of said housing for locking the rotating movement of said cam.

9. A connection system according to claim 6, wherein said groove in said lower part of said housing has an elastomer or silicone transversal rib in order to improve adhesion.

10. A connection system for the connection of a branch flexible flat strip cable comprising a principal flexible flat strip cable with a cam arranged in a housing, adapted for the pressing against one another of areas of the cables which are stripped from insulation, wherein said cam winds said branch flexible flat strip cable during its rotation, into its end position on a flexible arm and the areas of contact of said cables rub against one another.

* * * * *